US005829406A

United States Patent [19]

Mazzola et al.

[11] Patent Number: 5,829,406

[45] Date of Patent: Nov. 3, 1998

[54] BALANCING CRANKCASE PRESSURE

[75] Inventors: James Joseph Mazzola, Dryden; Terry Wayne Black, Clarkston, both of Mich.

[73] Assignee: General Motors Corporation, Detroit, Mich.

[21] Appl. No.: 904,285

[22] Filed: Jul. 31, 1997

[51] Int. Cl.[6] ..... F02F 7/00

[52] U.S. Cl. ..... 123/195 R; 123/195 H

[58] Field of Search ..... 123/195 H, 195 C, 123/195 R

[56] References Cited

U.S. PATENT DOCUMENTS

| | | | |
|---|---|---|---|
| 4,729,352 | 3/1988 | Fukuo et al. | 123/195 C |
| 5,107,809 | 4/1992 | Suh | 123/195 H |
| 5,579,729 | 12/1996 | Batzill et al. | 123/196 R |

*Primary Examiner*—John T. Kwon

*Attorney, Agent, or Firm*—Karl F. Barr, Jr.

[57] ABSTRACT

An engine assembly is disclosed which includes a cylinder block having cylinders, pistons disposed in the cylinders, and connecting rods connecting the pistons to a crankshaft. The crankshaft rotates to move the pistons reciprocally in the cylinders thereby inducing volumetric changes within the engine and, particularly between axially adjacent pistons. A crankcase disposed below the cylinder block has axial sidewalls extending therefrom to define a crankcase volume in which the crankshaft is disposed for rotation. Crankcase bulkheads extend laterally to connect the axial walls and define cylinder bays therebetween. Each of the crankcase bulkheads includes a crankshaft journal support and a surface configured to rotatably receive a complementary bearing cap for support of the crankshaft therebetween. The sidewalls include outwardly relieved portions at the intersection of the bulkheads with the crankcase sidewalls to define openings around the bearing caps to allow airflow, induced by the volumetric changes, between the cylinder bays.

2 Claims, 4 Drawing Sheets

BALANCING CRANKCASE PRESSURE

TECHNICAL FIELD

The present invention is directed to crankcases for internal combustion engines.

BACKGROUND OF THE INVENTION

Typical automotive internal combustion engines have crankcase pressures that vary with each rotation of the crankshaft. The continuously changing volume in each segment or "bay" of the engine crankcase is a result of reciprocal piston movement in each cylinder. The instantaneous volume of each bay is dependent on the number of engine cylinders, the bore and stroke of the engine, and the crankshaft configuration. The volume variations are uniformly cyclic with each crankshaft rotation. The resultant volume variations result in crankcase generated pressure pulsations which may vary greatly depending on characteristics such as engine displacement and on the number of pistons. The volume variations and resultant pressure pulsations occurring between the cylinder banks causes substantial movement of crankcase air and turbulence in the crankcase as equalization is sought.

It is desirable that pressure equalization is quickly and effortlessly achieved between engine cylinder bays in order to prevent substantial pumping losses from detrimentally affecting engine performance. Some cylinder block designs utilize a "short skirt" in which the side walls of the crankcase terminate at or near the axis of the crankshaft. Such short-skirted crankcases have a natural communication path around the main bearing caps and through the oil pan that allows the pumping pressure pulses in each cylinder bay to equalize with each stroke.

Cylinder block designs having longer side walls, or "deep skirts", are utilized to enhance engine stiffness and thereby decrease distortion and noise. Main bearing caps can be given added support by attaching them to the crankcase with four bolts instead of two. Cross bolts are also used in some applications to tie the bearing caps to the crankcase walls. With a deep skirted crankcase however, the communication passage for pressure pulses can be substantially blocked by the bulkheads which extend between the crankcase sidewalls. Extending the distance between the crankshaft and the oil in the sump, by increasing the oil pan depth or reducing oil volume, is not usually an option due to the competing concerns of lubrication performance and vehicle packaging. Passages may be provided through the bulkheads, above the crankshaft and between the cylinder bores. These air passages should be relatively large due to the high air velocities created between cylinder bays which, if directed back and forth over the oil surface in the sump, can induce wave action and subsequent aeration of the oil. Such passages are in a highly stressed area of the crankcase with the result that the optimum cross sectional area is rarely attainable without structural weakness. These passageways are also susceptible to periodic closure by the crank shaft throws as they rotate past the openings thereby interfering with free communication between cylinder bays.

SUMMARY OF THE INVENTION

The invention is directed to an engine assembly having provision for air communication between adjacent cylinder bays which allows pressure pulsations caused by volume variations to be equalized rapidly with a minimum of inflicted pumping loss. In a preferred embodiment of the invention, a deep skirt engine crankcase includes periodically relieved inner side-walls. The relieved portions are located adjacent the ends of the bearing caps and act as passages around the bearing cap ends for the movement of air due to unequal pressures in adjacent engine bays. By relieving the inner walls of the crankcase the total cross section of flow area provided around the ends of the bearing caps is substantially increased. In addition, the relief of the crankcase side walls results in "convoluted" or "corrugated" surfaces which operates to stiffen the walls against vibration and noise.

In a second preferred embodiment of the invention relieved portions of the engine crankcase sidewalls may be located adjacent the ends of the bearing caps and above lateral extensions at the ends of the bearing caps which facilitate cross bolting of the bearing caps to the crankcase side walls.

Other objects, features and advantages of the invention will become apparent by reference to the following description and to the drawings.

DESCRIPTION OF THE PREFERRED EMBODIMENT

Figure 1:
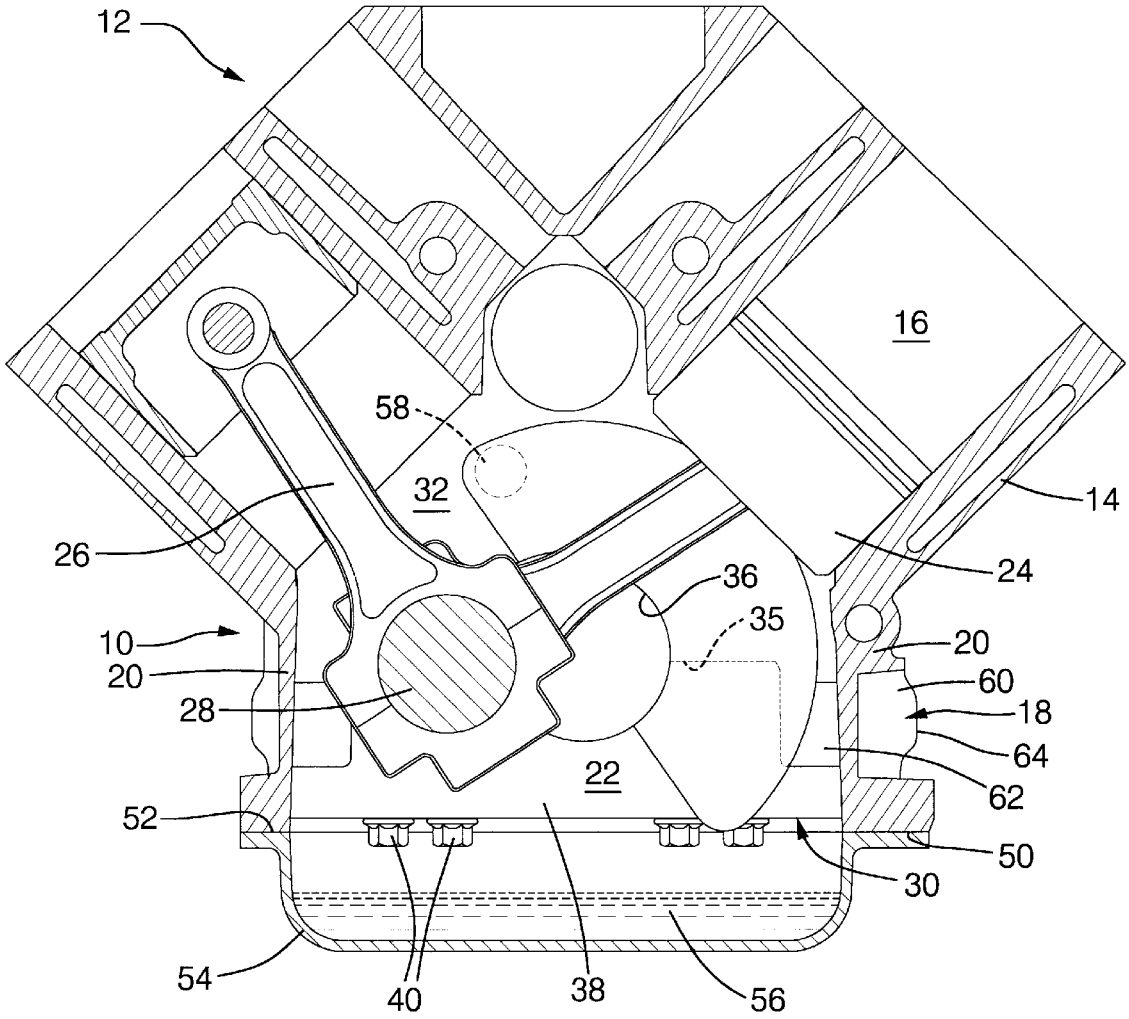
FIG. 1 is a schematic cross-section of a crankcase assembly, with parts missing, of an internal combustion engine.
Figure 2:
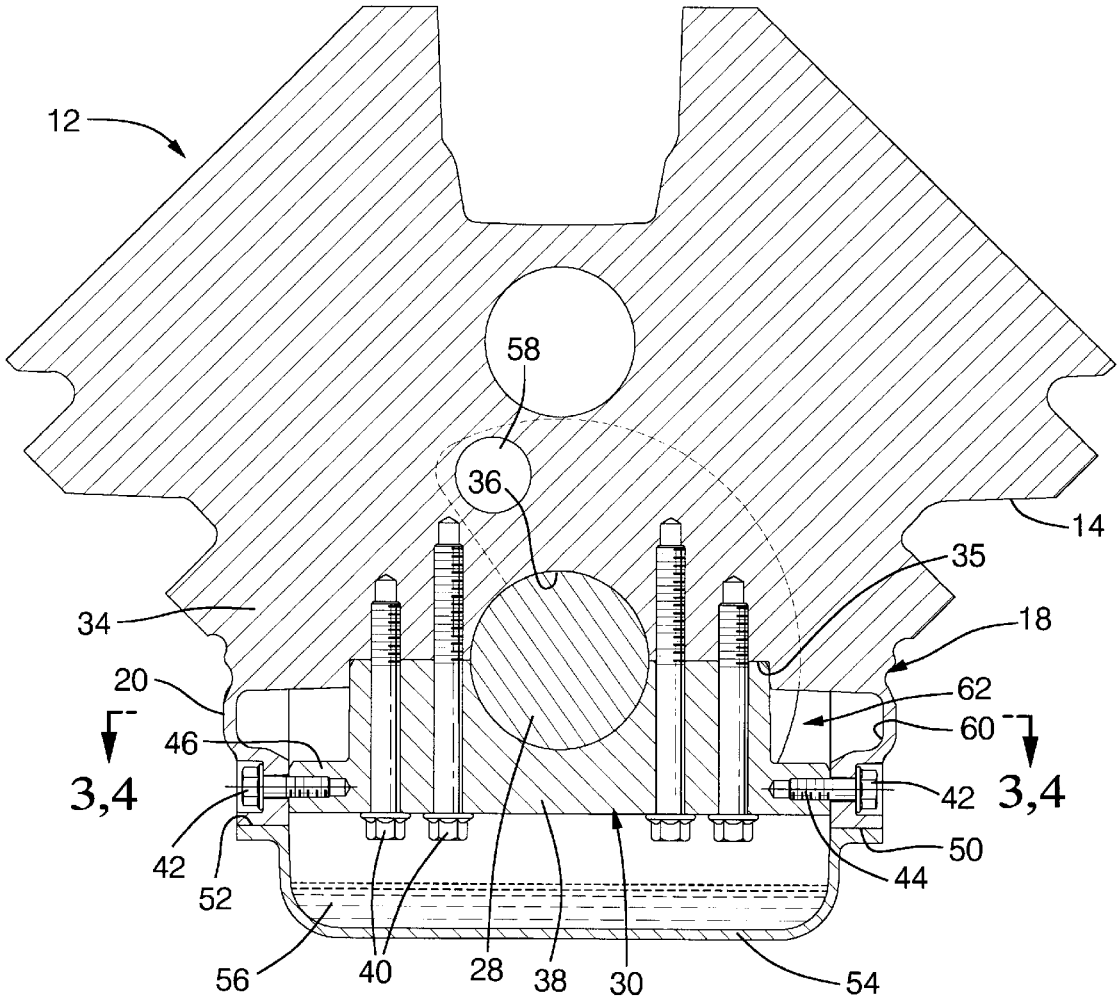
FIG. 2 is a second cross section of the crankcase assembly of FIG. 1.
Figure 3:
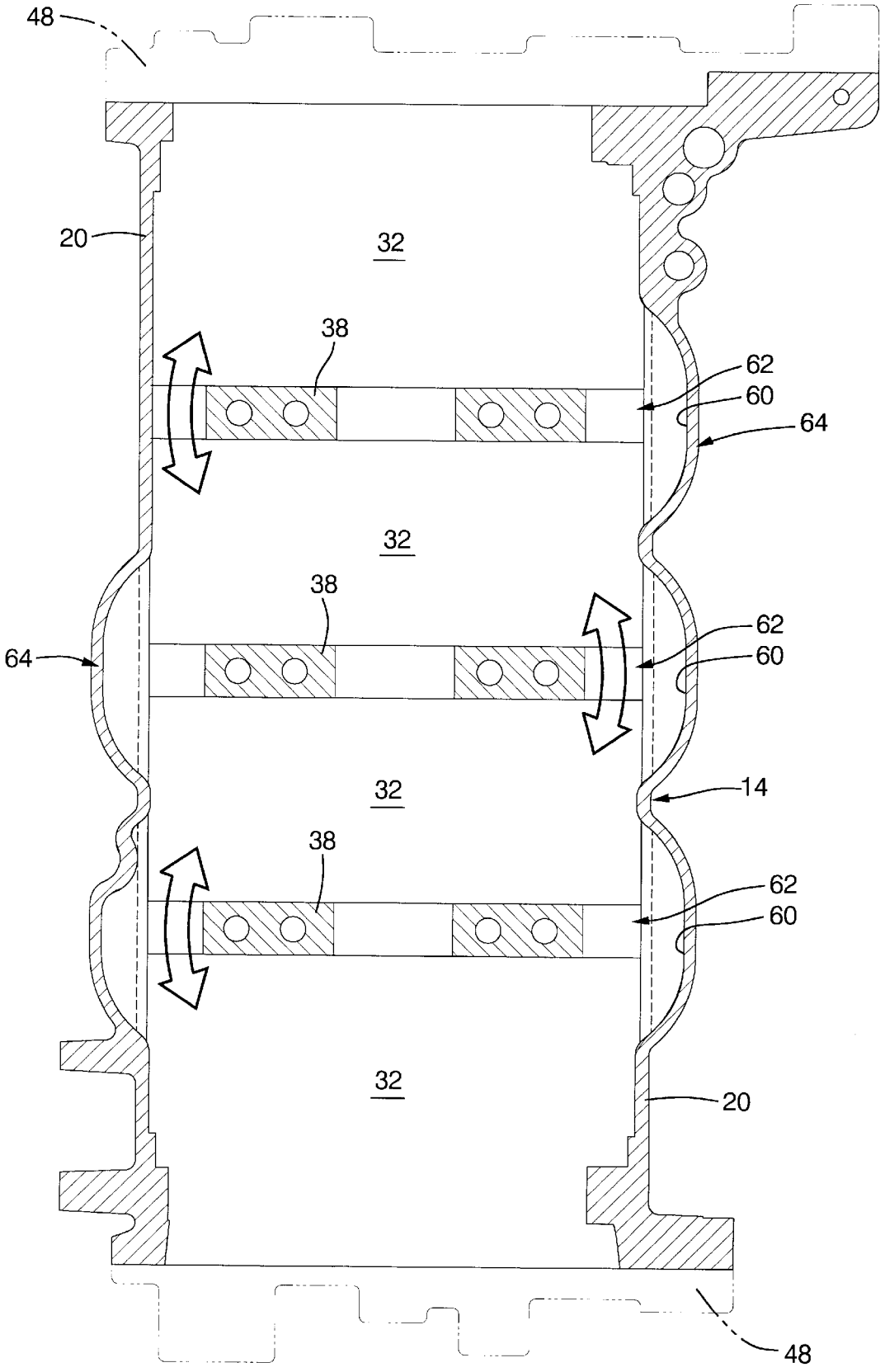
FIG. 3 is a longitudinal sectional view of the crankcase assembly of FIG. 2, taken along section 3—3.

In FIGS. 1 and 2 there is illustrated an engine assembly 10 for an internal combustion engine designated generally as 12. The engine assembly is defined by a cylinder block 14 having a plurality of cylinders 16 disposed therein. Below the cylinder block is a crankcase 18 defined by axial sidewalls 20 which extend downwardly from the cylinder block 14 to define a volume 22. Within each cylinder 16 of the cylinder block 14 is disposed a piston 24 which is reciprocally moveable therein, in a manner understood by those versed in the art of engine design. Each piston 24 is connected through a connecting rod 26 to a rotatable crankshaft 28 which is rotatably disposed in the crankcase 18 through the use of journal bearing assemblies 30.

Each piston 24, or pair of opposing pistons as in the case of a V-configured engine, is partially contained in a structural portion of the engine assembly referred to as a bay 32. Each bay 32 is defined, as illustrated in FIGS. 2, by laterally extending crankcase bulkheads 34 which extends from the bottom of the cylinder block 14 and structurally interconnects the longitudinally extending side walls 20 of the crankcase 18 so as to provide a rigid engine assembly. Each crankcase bulkhead 34 includes, at its lower end, a journal support surface 36 as well as being configured to receive a complimentary bearing cap 38 for support of the crankshaft 28 therebetween. Bearing cap bolts 40 extend upwardly through the bearing cap 38 and into the crankcase bulkhead 34 creating a rigid supporting structure for the crankshaft 28. In one preferred embodiment shown in the Figures, cross-bolts 42 extend through the longitudinal side walls 20 of the crankcase 18 and into threaded openings 44 in lateral bearing cap extensions or wings 46 to provide additional structural rigidity to the bearing assemblies 30.

The axial sidewalls 20 of the crankcase 18 combine with endwalls 48 to enclose the crankcase volume 22. The lower ends of the crankcase endwalls 48 and crankcase sidewalls 20 define a flanged sealing surface 50 which receives a complimentary flanged surface 52 of an oil pan or sump 54 to enclose the lower portion of the engine assembly 10 and to contain a fluid lubricant such as engine oil 56.

Referring to FIG. 1, rotation of the crankshaft 28 during operation of the engine 12 causes the pistons 24 to move within the cylinders 16 thereby inducing a volumetric change within each respective piston bay 32. The volume of air trapped in any particular bay 32 varies during rotation of the crankshaft 28 and is typically dependent on the cylinder size, the number of cylinders, engine configuration, connecting rod length and piston stroke. The volume difference between bays will typically depend on the relative location of each piston or pair of pistons contained between crankcase bulkheads 34. If there is no route in the crankcase for air to flow between bays, air will be forced into the valve overhead area (not shown) or back and forth through the sump 54. These situations are not acceptable as they induce oil foaming and aeration.

Referring to FIG. 2, an opening 58 may be provided in each crankcase bulkhead 34 through which air can flow between bays 32 to reduce pressure pulsations. The opening 58 are typically located above the crankshaft 28 in a highly stressed area of the bulkhead 34 and is therefore size limited. The longitudinal sidewalls 20 of the crankcase 18 are provided with a plurality of outwardly relived portions 60 located below each bulkhead 34. By locating the recesses 60 substantially below the bulkheads 34 and at the intersection of the bulkhead with the crankcase walls 20 , a flow path or opening 62 is defined around the end of each journal bearing assembly 30 when the bearing caps 58 are installed on the journal support faces 36 at the lower end of the bulkheads. The recesses 60 can be used to solely define the flow path 62 or, as shown in FIG. 2, can complement the surface of the bearing cap 30, together defining the opening 62. An advantage of the recessed crankcase sidewalls 20 is the ability of the engine designer to use an extended skirt crankcase, and derive the structural benefits inherent in such a configuration, without limiting the ability of the engine crankcase 18 to balance pressure variations between adjacent bays 32.

Since the crankcase walls 20 serve as a containment mechanism for engine fluids as well as suppressers of internally generated noise, the use of the outwardly relieved portions 60, as described herein, operate to define a convoluted wall surface 64 which is effective to limit various modes of vibration due to an increase in stiffness. Such an increase in crankcase stiffness is effective in the reduction of noise generated by the engine assembly 10.

Figure 4:
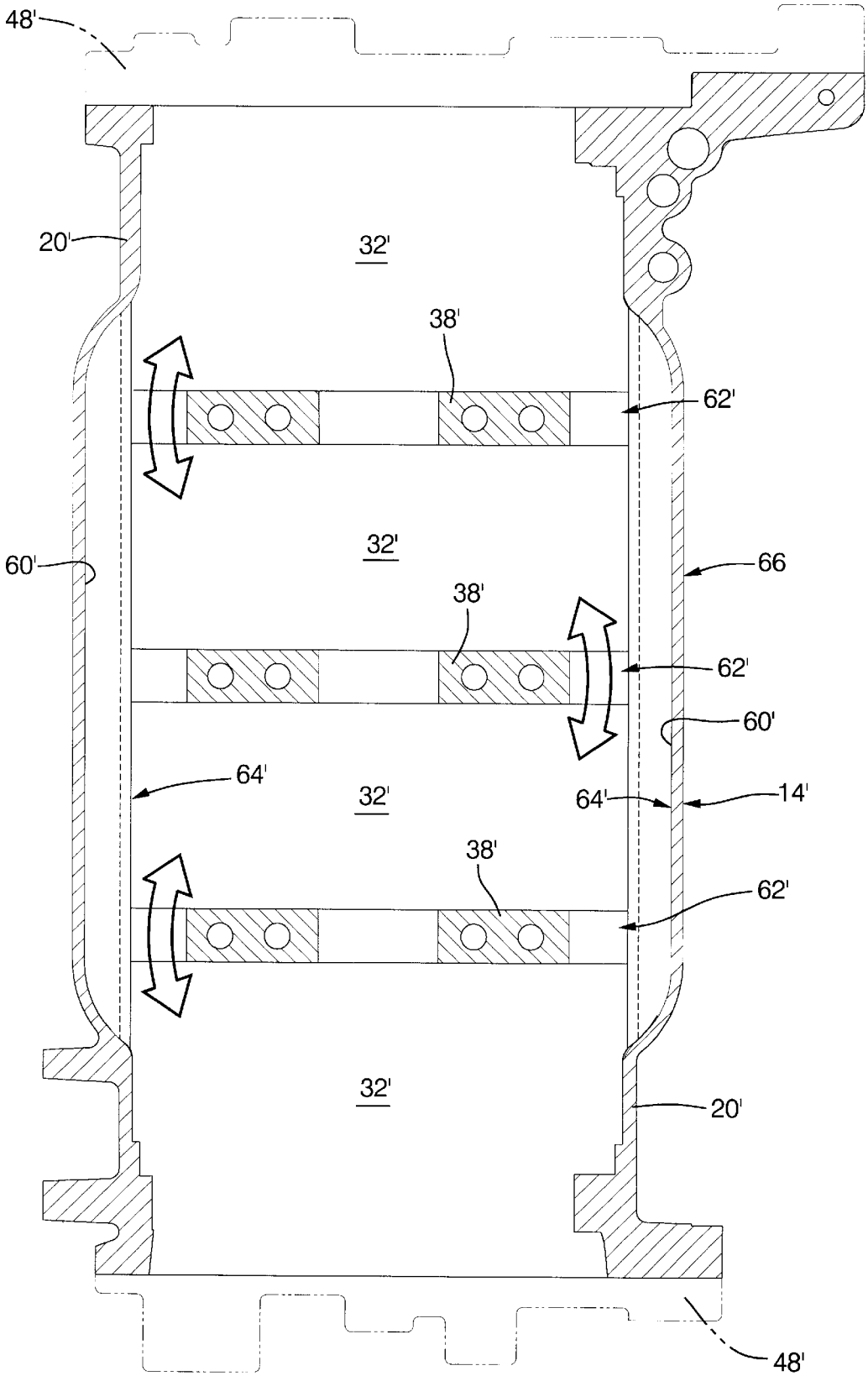
FIG. 4 is a longitudinal sectional view of the crankcase assembly of FIG. 2, taken along section 4—4 and illustrating an additional embodiment of the present invention.

Although the preferred embodiment of the invention described above is directed to an engine assembly 10 having a series of individual recesses 60 located in an axially spaced arrangement along the crankcase wall 20, other arrangements are also contemplated depending upon the specific engine configuration as well as structural requirements. As an example, FIG. 4 illustrates an engine crankcase 18' having a continuous recess 60' extending axially along the length of the crankcase wall 20'. The placement of a single recess 60' imparts a corrugated surface 66 to the crankcase wall 20' which will deliver structural properties different from that of the convoluted wall 64 described above, while continuing to provide flow paths 62' through the crankcase bulkheads 34' to allow movement of air caused by pressure differences in adjacent engine bays 32'.

The foregoing description of the preferred embodiments of the invention has been presented for the purpose of illustration and description. It is not intended to be exhaustive nor is it intended to limit the invention to the precise forms disclosed. It will be apparent to those skilled in the art that the disclosed embodiments may be modified in light of the above teachings. The embodiments described were chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. An engine assembly comprising a cylinder block having cylinders, pistons disposed in said cylinders, and connecting rods connecting said pistons to a crankshaft, said crankshaft rotatable to move said pistons reciprocally in said cylinders to induce volumetric changes within said engine, a crankcase having axial sidewalls extending from said cylinder block to define a crankcase volume in which said crankshaft is disposed for rotation, and lateral bulkheads extending from said cylinder block and operable to connect said axial sidewalls and define cylinder bays therebetween, each of said crankcase bulkheads including a crankshaft journal support surface configured to rotatably receive said crankshaft and a complementary bearing cap for support of said crankshaft therebetween, said sidewalls including an outwardly relieved portion at the intersection of said bulkheads and said crankcase sidewalls to define an opening around said bearing caps for the flow of air between said cylinder bays.

2. An engine assembly comprising a cylinder block reciprocally moveable pistons operable to induce volumetric changes therein, a crankcase having axial sidewalls extending from said cylinder block to define a crankcase volume, and laterally extending bulkheads operable to connect said axial walls and define cylinder bays therebetween, said axial sidewalls including an outwardly relieved portion at the intersection with said bulkheads to define an opening between said cylinder bays for the flow of air induced by said volumetric changes.

* * * * *